US007964067B2

(12) United States Patent
Funahashi

(10) Patent No.: US 7,964,067 B2
(45) Date of Patent: Jun. 21, 2011

(54) CORROSION CONTROL OF BOTTOM PLATES IN ABOVE-GROUND STORAGE TANKS

(76) Inventor: Miki Funahashi, West Chester, PA (US)

( * ) Notice: Subject to any disclaimer, the term of this patent is extended or adjusted under 35 U.S.C. 154(b) by 585 days.

(21) Appl. No.: 12/032,735

(22) Filed: Feb. 18, 2008

(65) Prior Publication Data

US 2009/0205951 A1 Aug. 20, 2009

(51) Int. Cl.
*C23F 13/20* (2006.01)
*C23F 13/06* (2006.01)
*C23F 13/14* (2006.01)

(52) U.S. Cl. ..... 204/196.37; 204/196.18; 204/196.21; 204/196.23; 204/196.25; 204/196.3; 204/196.36

(58) Field of Classification Search ..... 204/196.18, 204/196.21, 196.23, 196.25, 196.3, 196.36, 204/196.37
See application file for complete search history.

(56) References Cited

U.S. PATENT DOCUMENTS 6,022,469 A * 2/2000 Page ..... 205/734
6,193,857 B1 * 2/2001 Davison et al. ..... 204/196.01
6,303,017 B1 * 10/2001 Page et al. ..... 205/734
2004/0238376 A1 12/2004 Whitmore

* cited by examiner

*Primary Examiner* — Bruce F Bell
(74) *Attorney, Agent, or Firm* — Gifford, Krass, Sprinkle, Anderson & Citkowski, P.C.

(57) ABSTRACT

A corrosion control system for an above-ground storage tank having a steel bottom plate comprises a sacrificial anode disposed under and spaced apart from the steel bottom plate in a backfill material, and wherein the backfill material has a pH high enough to cause a substantial passivation of the surface of the steel plate facing the sacrificial anode while substantially preventing the passivation of the sacrificial anode. In the preferred embodiment the backfill material has a pH of 10 or greater and the sacrificial anode is in the form of a plate or mesh composed of aluminum or an alloy thereof. Alternatively the sacrificial anode may be composed of zinc or an alloy thereof. The backfill material further includes soda ash, trisodium phosphate or other high alkaline chemicals to raise the pH. The backfill material also preferably includes a moisture retention material such as zeolite to maintain a minimum of moisture content of 10 percent or greater.

9 Claims, 1 Drawing Sheet

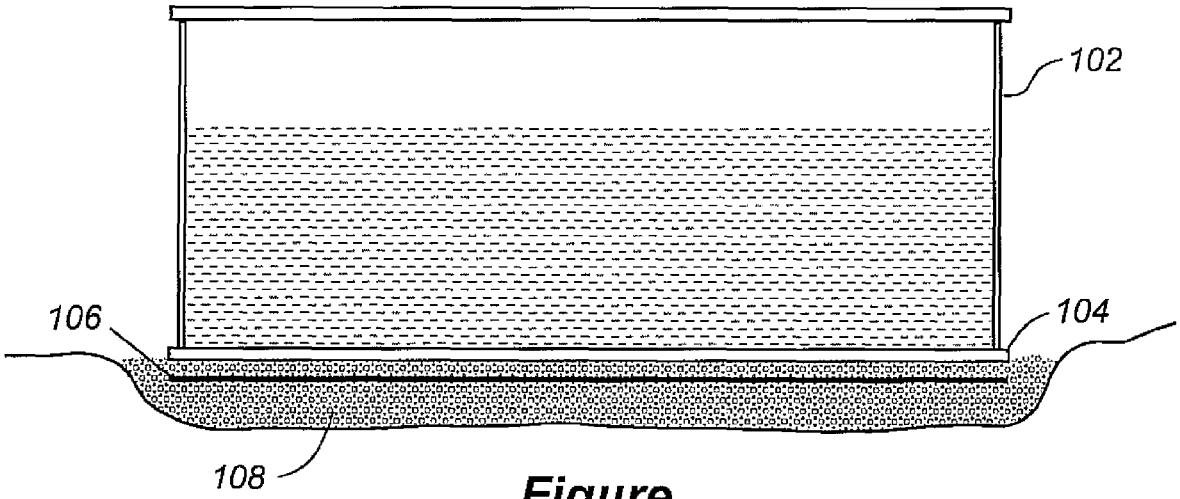
Figure

CORROSION CONTROL OF BOTTOM PLATES IN ABOVE-GROUND STORAGE TANKS

FIELD OF THE INVENTION

This invention relates generally to corrosion control and, in particular, to the use of sacrificial anodes and backfill materials to control the corrosion of steel bottom plates in above-ground storage tanks.

BACKGROUND OF THE INVENTION

The bottom plates of above-ground storage tanks are subject to corrosion. In some situations, the tank bottom may be protected from corrosion by oil sand, asphalt sand or impressed current cathodic protection with sand and/or electrochemical techniques.

Protection by oil or asphalt sand tales advantage of the dielectric, non-electrolytic properties of the oil or asphalt. Recently, however, the effectiveness of this approach has been questioned due to corrosive tank failures resulting from insufficient dielectric protection. In addition, water or rain intrusion from the edge of the tank bottom plate may accelerate corrosion in those areas.

Impressed current systems generally use an inert anode with a transformer rectifier (DC power supply) to generate cathodic protection current. The anode is typically embedded in sand. The cathodic protection current from the anode travels through the sand or soil electrolyte which contacts the steel plate and protects the tank plate from corrosion. So long as the tank plate contacts the sand electrolyte, the impressed current cathodic protection is effective.

However, when the product inside the tank becomes depleted or emptied, the tank plate may rise from the sand or soil, resulting in the development of air gaps in some areas. If this occurs, the cathodic protection current cannot reach the tank steel surfaces located over air Caps because the air cannot transfer the cathodic protection current. As a result, the effectiveness of the corrosion protection using an impressed current cathodic protection system is lost, and those areas are subject to corrosion.

In addition, since cathodic protection is continuously operating system, interruption or malfunction of the transformer rectifier or damage of any cathodic protection hardware stops the protection of the steel plate from corrosion. Therefore, the continuous maintenance of the transformer rectifier with all associated hardware is mandatory to protect the tank plate.

Published U.S. Patent Application Serial No. 2004/0238376 A1 discloses a method for cathodically protecting tank bottom steel plate using a sacrificial anode such as zinc or aluminum alloy sheets embedded in sand or soil. However, a disadvantage of this system is that the sacrificial anode passivates and becomes nonfunctional in a relatively short period of time.

To achieve sufficient cathodic protection current through sacrificial metals such as zinc, aluminum, or their alloys, the metals must corrode or oxidize to generate cathodic protection current. However, these metals only corrode in a very low or high pH electrolyte environment. If the electrolyte has a pH less than approximately 10 in the absence of high chloride concentrations, these metals do not corrode due to passivation.

Furthermore, when such metals corrode, oxide products build up at the interface between the sand and the anode. The pH of the aluminum or zinc oxide products is approximately 5 to 7. This means that the aluminum or zinc metal underneath the oxide products is exposed to a neutral pH. As a result, the aluminum or zinc metal strongly passivates and becomes stable and non-corroding metal. When this occurs, they cannot function as sacrificial anode to protect the tank steel plate.

To minimize the passivation of zinc or zinc alloys, calcium bentonite and gypsum based backfill materials may be used. The zinc anode is embedded in the backfill material in a cloth bag to minimize the zinc passivation. The bulk zinc anode in the cloth bag with the backfill material is not suitable for tank bottom plates, however, due to poor current distribution from the localized anode to the entire tank plate. By significantly increasing the number of the anodes to uniformly distribute current to the tank plate, cathodic protection using bulk anodes is feasible. However, the cost of such a system is significantly high. In addition, this type of the backfill material is corrosive to the steel plate, it make more difficult to protect the tank bottom.

Aluminum or aluminum alloys are generally used for seawater or brackish water electrolytes as a sacrificial anode because the high chloride concentration prevents the passivation of the aluminum. The aluminum anode has high electrical capacity (greater than 2900 amp-hours/kg) and high efficiency (greater than 90%). In sand or soil environments, however, the aluminum or aluminum alloy does not function as a sacrificial anode due to passivation. Another disadvantage is that because the steel plate is exposed to sand or soil, the passivated zinc or aluminum anode cannot produce a sufficient level of current to protect the steel plate.

Corrosion protection using magnesium sacrificial anodes is commonly used to protect the steel contacting to soil or sand environment because magnesium anode does not passivate in a neutral pH electrolyte. The electrical capacity of magnesium anode is approximately 1,230 amp-hours/kg with less than 50 percent efficiency. The magnesium anode is generally provided as a bulk anode in a cloth bag with a backfill material similar to that used with a zinc anode. As such, the cost of sacrificial magnesium anode cathodic protection is significantly high. Furthermore, as with impressed current cathodic protection current, sacrificial anode systems cannot protect the steel plate across air gaps. As a result, the effectiveness of the corrosion protection of steel tank plates is limited.

SUMMARY OF THE INVENTION

This invention resides in a corrosion control system for an above-ground storage tank having a steel bottom plate. In broad and general terms, the system comprises a sacrificial anode disposed under and spaced apart from the steel bottom plate in a backfill material, and wherein the backfill material has a pH high enough to cause a substantial passivation of the surface of the steel plate facing the sacrificial anode while substantially preventing the passivation of the sacrificial anode. In the preferred embodiment the backfill material has a pH of 10 or greater.

In the preferred embodiment the sacrificial anode is in the form of a plate or mesh composed of aluminum or an alloy thereof. Alternatively the sacrificial anode may be composed of zinc or an alloy thereof. The backfill material further includes soda ash, trisodium phosphate or other high alkaline chemicals to raise the pH. The backfill material also preferably includes a moisture retention material such as zeolite to maintain a minimum of moisture content of 10 percent or greater.

BRIEF DESCRIPTION OF THE DRAWINGS

FIG. 1 is a drawing that shows an implementation of the invention.

DETAILED DESCRIPTION OF THE INVENTION

According to this invention, when aluminum, zinc, or alloys thereof are embedded in a high pH electrolyte, the formation of the passive film on the metal can be prevented. This allows these metals to function as a cathodic protection anode. Additionally when steel is in contact with a high pH electrolyte (preferably 10 or greater), the steel passivates and develops a stable protection film on its surface, resulting in no corrosion until the film is disrupted. Additionally, the use of cathodic protection develops a strong passive film on the steel surface because the cathodic reactions produce sufficient hydroxyl ions (OH) which act as a source of high pH. Once the strong passive film is formed, the steel plate can maintain the protection film even if the tank plate losses contact with the soil or sand underneath.

Exploiting the electrochemical characteristics of aluminum, zinc or their alloys in a high pH environment, as well as the electrochemical characteristics of steel in a high pH electrolyte, the invention provides a sacrificial anode cathodic protection system for tank bottom steel plates using a newly invented backfill material in conjunction with bare zinc or aluminum mesh or plates. The mesh or plates embedded in the inventive backfill material, positioned under the tank plate, provide uniform corrosion protection to the entire tank plate.

According to the invention, the required cathodic protection current density to the passivated steel tank bottom plate in the high pH environment is significantly smaller than that for non-passive steel (typically less than 10%). As such, a relatively small amount of cathodic protection current is required to protect the tank plate. In other words, a relatively small sacrificial anode is sufficient to protect the tank plate. The invention may be implemented with mesh or plate forms of aluminum, aluminum alloys, zinc, and zinc alloys. However, the most preferred materials are aluminum or alloys thereof due to the cost-effectiveness of high electrical capacity and the high efficiency.

FIG. 1 is a drawing that shows a typical implementation of the invention. The tank is depicted at 102 and the bottom plate is shown at 104. The mesh or plate is shown at 106 which is embedded in backfill 108. Typically for new construction the area under the tank will be first excavated and backfilled though a mound of backfill with the embedded mesh or plate may alternatively be used. The mesh or plate 106 may be spaced apart from the steel plate 104 by any reasonable distance from less than an inch to more than a foot, through preferably without any direct contact. The invention is not limited in terms of the size of the tank being protected.

The electrical capacity of a typical aluminum anode is greater than 2900 amp-hours/kg, and the efficiency of aluminum is greater than 90%. However, because of the strong passivation tendency of the aluminum anode in free or low chloride concentration environments, it cannot be used in earth burial applications. Even if an aluminum anode is embedded in a backfill material containing a high chloride concentration, the chloride ions readily diffuse to the surrounding soil in a short period of time. Therefore, aluminum or aluminum alloys cannot conventionally function as a cathodic protection anode in earth burial conditions.

However, by embedding the plate or mesh of aluminum or aluminum alloys in a high pH backfill material which can be used as the foundation material for the tank plate, the prevention of the passivation is achieved. As a result, these metals function as a cathodic protection anode. Plates or mesh of zinc or zinc alloys can also be used in the high pH back-fill according to the invention.

When the steel contacts a high pH electrolyte (greater than 10), the steel passivates and develops a thin protection film on the steel surface. A typical example of passivated steel in a high pH electrolyte is reinforcing steel in chloride-free concrete. When the steel embedded in a neutral pH soil or sand electrolyte, 20 to 50 $mA/m^2$ of cathodic protection current density is required to control the corrosion. On the other hand, to protect the steel in a high pH electrolyte using cathodic protection, much smaller amount of cathodic protection current is required (typically 1 to 3 $mA/m^2$) to control the corrosion. This lower cathodic protection current requirement to protect the steel significantly reduces the size of the sacrificial anode.

To maintain these effects for the aluminum or zinc and the steel plate, an inventive backfill material keeps the high pH and preferably some moisture during the life of the anode. The preferred embodiment uses high pH buffering materials in combination with a non de-composited, water absorbing material, such as zeolite.

In existing installations, when the steel plate rises from the soil or sand, air gaps can develop underneath the steel. In this situation, cathodic protection does not protect those areas because the current from the anode cannot travel through the air gap to the steel plate. As a result, the cathodic protection capability is lost during such periods. However, when the cathodic protection is used with a high pH backfill in accordance with the invention, a strong passive film develops on the steel surface in a short period of time. This passive film protects the tank plate over the air gaps for long period of time in such a condition even without receiving cathodic protection current.

The present invention comprises the following simultaneous advantages and benefits:

1. The capability to use sacrificial aluminum or zinc anodes for steel plates for above-ground storage tanks for extended periods of time.
2. The mesh or plate form of the sacrificial anode provides uniform corrosion control to the entire tank plate.
3. A relatively small amount of the sacrificial anode is required to protect the steel plate due to the significantly low current demand of the passivated steel plate.
4. The prevention of corrosion of the steel plate can be achieved in areas over air gaps.

To achieve the items listed above, a special backfill material was invented that has the following properties:

1. It maintains high per as a buffer backfill material for a long period of time.
2. It holds reasonable amount of moisture for a long period of time to make the sacrificial anode active.
3. It is physically stable and durable to hold the above ground storage tanks.
4. It is stable during the welding process of the steel tank bottom plates during construction.

EXAMPLE

Two aluminum plates (220 mm×220 mm×1 mm) and two steel plates (280 mm×280 mm×3 mm) were prepared. The steel plates were welded in center to simulate field tank fabrication. The initial weights of the aluminum mesh and the steel plates were 135 grams and 1800 grams, respectively.

The following types of backfill materials were prepared:

Backfill A (as control), which consists of sand, zeolite and water. The pH of this backfill was approximately 8. The water content is approximately 18 percent. Zeolite was used to maintain high moisture content of the backfill material.

Backfill B (High pH buffer material), consists of sand, zeolite, Soda Ash, trisodium phosphate (TSP) and water. The following ranges for the materials are appropriate to the invention.

Sand: 40 to 70%
Zeolite: 10 to 40%
Water: 10 to 30%
TSP: 0.2 to 2%
Soda Ash: 0.2 to 4%.

The particular composition that we tested had the following ingredients:

Sand: 10 kg (53.5%)
Zeolite: 5 kg (26.7%)
Water: 3.5 kg (18.7%)
TSP: 0.1 kg (0.55%)
Soda Ash 0.1 kg (0.55%)

The pH of this backfill is 11. The water content is also about 18 percent.

One of the aluminum plates was embedded in Backfill A, and the other in Backfill B, each in a separate plastic container. The height of each backfill material was approximately 100 mm, and the aluminum plate was positioned at the mid depth of the backfill.

A steel plate was laid on the top of each backfill. The steel plate and the aluminum plate were connected through 0.1 ohm shunt resistor and a switch to measure the current output. The potentials were measured using a portable copper/copper sulfate reference electrode. The effectiveness was monitored for 6 months. After the 6 month test, the steel and the aluminum plates were removed from the backfill to visually observe the corrosion conditions. The results are summarized as follows.

Backfill A:

1. The steel plate was never cathodically protected by the aluminum plate anode. (Table 1).

2. The static potential of the aluminum plate indicated that it passivated after 60 days of the test period. (Table 2).

3. The static potential of the steel plate indicated that it did not passivate, and the steel plate was actively corroding. (Table 3).

Backfill B:

1. Back-fill B enhanced the aluminum anode activities, and the aluminum plate protected the steel plates based on the 100 mV depolarization criterion for cathodic protection (Table 1). The criterion was readily achieved much lower current than that in Backfill A.

2. The static potentials of the aluminum plate indicated that it did not passivate in the backfill. (Table 2)

3. The static potential of the steel plate indicated that it was passivated in 3 days from the commissioning.

After the 6-month test period, the aluminum and the steel plates showed the following conditions:

Backfill A:

1. The aluminum plate did not show any corrosion loss. No corrosion stains were observed on the aluminum plate, and the surface was completely smooth, indicating passivation of the aluminum plate.

2. The steel plate showed significant corrosion by brown rust stains on the entire surface.

3. The pH on the steel and the aluminum plate surfaces were approximately 6 and 8, respectively. The pH at the aluminum-backfill interface coincided with the passive potential of the aluminum.

Backfill B:

1. The aluminum plate showed corrosion stains on the entire surface facing the steel plate. Some corrosion pits were also detected. The face which was not facing the steel plate showed slight corrosion stains, but no pits. The material loss by the corrosion was less than 1 percent.

2. The steel plated showed uniform black stained passive film on the entire surface. The surface was completely smooth. No corrosion loss was observed.

3. The pH on the steel and the aluminum plate surfaces were approximately 10 and 9, respectively. These potentials coincided with the conditions of the aluminum and the steel plate in the backfill.

TABLE 1

Results of cathodic protection.

| | Backfill A | | Backfill B | |
|---|---|---|---|---|
| Test duration (days) | Cathodic protection current density (mA/m) | Amount of depolarization (mV) | Cathodic protection current density (mA/m2) | Amount of depolarization (mV) |
| 14 | 3 | 33 | 1 | 165 |
| 26 | 1.63 | 27 | 0.88 | 168 |
| 61 | 0.6 | 10 | 0.75 | 124 |
| 84 | 0.4 | 4 | 0.2 | 132 |
| 96 | 0.35 | 8 | 0.35 | 154 |
| 180 | 0.22 | 32 | 0.2 | 130 |

TABLE 2

Static potentials of the aluminum anodes

| Test Duration (days) | Aluminum static potential in Backfill A | Aluminum static potential in Backfill B |
|---|---|---|
| 14 | −974 | −1485 |
| 26 | −833 | −1115 |
| 61 | −655 | −1127 |
| 84 | −506 | −1109 |
| 96 | −457 | −1120 |
| 180 | −450 | −947 |

TABLE 3

Static potential of the steel plates

| Test Duration (days) | Steel static potential in Backfill A | Steel static potential in Backfill B |
|---|---|---|
| 14 | −730 | −319 |
| 26 | −687 | −213 |
| 61 | −630 | −209 |
| 84 | −586 | −216 |
| 96 | −566 | −228 |
| 180 | −448 | −199 |

I claim:

1. A corrosion control system for an above-ground storage tank having a steel bottom plate, the system comprising:

a sacrificial anode disposed under and spaced apart from the steel bottom plate in a backfill material without making a direct, hard-wired electrical connection to the steel plate; and wherein the backfill material has a pH high enough to cause a substantial passivation of the surface of the steel plate facing the sacrificial anode while substantially preventing the passivation of the sacrificial anode.

2. The corrosion control system of claim 1, wherein the pH is 10 or greater.

3. The corrosion control system of claim 1, wherein sacrificial anode is in the form of a plate or mesh.

4. The corrosion control system of claim 1, wherein sacrificial anode is composed of aluminum or an alloy thereof.

5. The corrosion control system of claim 1, wherein sacrificial anode is composed of zinc or an alloy thereof.

6. The corrosion control system of claim 1, wherein the backfill material includes soda ash, trisodium phosphate or other high alkaline chemical.

7. The corrosion control system of claim 1, wherein the backfill material includes a moisture retention material.

8. The corrosion control system of claim 7, wherein the moisture retention material is a zeolite.

9. The corrosion control system of claim 1, wherein backfill material has a minimum of moisture content of greater than 10 percent.

* * * * *